United States Patent [19]

Allen et al.

[11] Patent Number: 4,980,719

[45] Date of Patent: Dec. 25, 1990

[54] COPIER/PRINTER AND METHOD FOR REPRODUCTION OF SECURE DOCUMENTS OR THE LIKE

[75] Inventors: James D. Allen, Greece; David M. McVay, Irondequoit; Eric C. Stelter, Brighton; Eugene D. Yeo, Clarendon, all of N.Y.

[73] Assignee: Eastman Kodak Company, Rochester, N.Y.

[21] Appl. No.: 365,590

[22] Filed: Jun. 13, 1989

[51] Int. Cl.[5] ..... G03G 21/00

[52] U.S. Cl. ..... 355/201; 355/202; 355/204; 355/133

[58] Field of Search ..... 355/201, 230, 133, 202, 355/204, 71; 283/901, 902; 235/449, 450, 435

[56] References Cited

U.S. PATENT DOCUMENTS

| | | | |
|---|---|---|---|
| 2,547,838 | 4/1951 | Russell . | |
| 3,676,644 | 7/1972 | Vaccaro et al. . | |
| 3,807,852 | 4/1974 | Hoydie | 355/133 X |
| 4,179,212 | 12/1979 | Lahr | 355/202 |
| 4,180,207 | 12/1979 | Lee . | |
| 4,313,087 | 1/1982 | Weitzen et al. . | |
| 4,455,039 | 6/1984 | Weitzen et al. . | |
| 4,486,090 | 12/1984 | Warhol . | |
| 4,586,811 | 5/1986 | Kubo et al. . | |
| 4,603,970 | 8/1986 | Aota et al. . | |
| 4,627,707 | 12/1986 | Tani et al. . | |
| 4,675,669 | 6/1987 | Goldman . | |
| 4,678,322 | 7/1987 | Finkel et al. . | |
| 4,723,149 | 2/1988 | Harada | 355/201 |
| 4,728,984 | 3/1988 | Daniele | 355/201 X |
| 4,739,377 | 4/1988 | Allen . | |
| 4,774,593 | 9/1988 | Deguchi et al. | 355/202 X |
| 4,777,510 | 10/1988 | Russel . | |
| 4,845,348 | 7/1989 | Ho et al. | 235/449 |
| 4,887,128 | 12/1989 | Jamali et al. | 355/202 |

FOREIGN PATENT DOCUMENTS

| | | | |
|---|---|---|---|
| 0224362 | 12/1983 | Japan | 355/201 |
| 0019170 | 1/1985 | Japan | 355/201 |
| 0250659 | 11/1986 | Japan | 355/201 |
| 61-255362 | 11/1986 | Japan . | |
| 61-258278 | 11/1986 | Japan . | |
| 0292667 | 12/1986 | Japan | 355/202 |
| 85/01128 | 3/1985 | World Int. Prop. O. | 355/201 |
| 85/01129 | 3/1985 | World Int. Prop. O. | 355/201 |

OTHER PUBLICATIONS

IBM Technical Disclosure Bulletin, "Copier Security System", vol. 18, No. 6, Nov., 1975, pp. 1747–1748.

IBM Technical Disclosure Bulletin, "Copier System for Confidential Papers", J. C. Marinace, vol. 15, No. 7, Dec., 1972, p. 2328.

IBM Technical Disclosure Bulletin, "Preventing Copying of Classified Information", vol. 19, No. 4, Sep. 1976, pp. 1469–1470.

*Primary Examiner*—A. T. Grimley
*Assistant Examiner*—Matthew S. Smith
*Attorney, Agent, or Firm*—Norman Rushefsky

[57] ABSTRACT

A reproduction method and apparatus provides for the secure reproduction of confidential documents that include image portions formed with magnetic or metallic toners. The method and apparatus of the invention also provides for the production of documents such as statements with checks having bank clearing data formed with magnetic toner, documents containing magnetically bar coded data, and documents recorded with either or both magnetic or nonmagnetic toner that may be distinguished when copied in accordance with a copying criterion established for reproducing secure documents.

19 Claims, 13 Drawing Sheets

COPIER/PRINTER AND METHOD FOR REPRODUCTION OF SECURE DOCUMENTS OR THE LIKE

BACKGROUND OF THE INVENTION

CROSS REFERENCE TO RELATED APPLICATIONS

This application is related to U.S. application Ser. No. 07/365,327, filed on even date herewith in the names of James D. Allen et al and entitled "Secure Copier and Method of Reproduction."

1. Field of the Invention

This invention relates to reproduction apparatus and methods for making reproductions of secure documents such as confidential documents and checks.

2. Description of the Prior Art

In the prior art, financial statements such as from insurance companies, are provided with a check forming a part thereof. As the bank clearing data portion of the check is required to be in a magnetic ink, it is known to reproduce the whole statement in the magnetic inks or such as by use of an electrostatographic reproduction process employing magnetic toners known as MICR toners. These toners referred to herein as magnetic or as a metal have a permeability to magnetic fields enabling them to be detected by known magnetic readers or sensors which are capable of detecting permeability, remanent magnetization, or magnetic fields such as produced by eddy currents. As magnetic toners are more expensive than nonmagnetic toners, it would be desirable to minimize the use of these toners to only where they are required. It is also known in the prior art to provide a form upon which a financial statement will be prepared. In the production of the form, a magnetic ink is added in a separate step to provide the bank clearing data. The modified form is then fed to a printer to print the amount and name of the individual. While this method reduces the use of magnetic ink to the required information needed to be printed with same, it is cumbersome since it requires that forms be previously prepared and placed correctly in the printer.

It is further known in the prior art (see commonly assigned U.S. Pat. No. 4,739,377) to provide for the secure reproduction of confidential documents by placing, say, an invisible toner on the document as a bar code to determine the level of security clearance required to copy the document. However, this can be defeated by the use of appropriate optical filters.

It is an object, therefore, to provide an improved method and apparatus for reproduction that provides for the secure production of confidential documents and which reduces the use of expensive toners.

SUMMARY OF THE INVENTION

In accordance with one aspect of the invention, a method and apparatus for the secure reproduction of documents is described wherein documents are fed seriatim to an exposure platen; and while the documents are moving toward or away from the exposure platen, the documents are sensed for the presence of metallic or magnetic content. A first signal is generated identifying a document as containing or not containing metallic or magnetic content and thereby distinguishing the nature of the document as a secure or not secure document. A user's authorization to make copies of secure documents is ascertained and a second signal generated indicative of said authority. In response to said first and second signals reproduction of said document is enabled when said signals define such authorization and sensing of a secure document.

In accordance with another aspect of the invention, a method and apparatus for the reproduction of copy having a first image area formed with non-metallic pigment and a second image area formed with metallic pigment is provided wherein the location of a metallic area on a document is sensed while said document is moving toward or away from an exposure platen and signals generated identifying said location; and in response to these signals there is reproduced on a recording element an image area corresponding to the first image area with non-metallic pigment and reproduced on an image area corresponding to the second image area with metallic pigment.

Still another aspect of the invention is directed to method and apparatus for production of copy, by electrostatic recording by producing a charge on a recording element that is modulated with image information; developing an area of the element that is modulated with image information with a non-magnetic pigment; producing a charge on a second area of the recording element for forming a patch; developing the second area of the recording element with a magnetic pigment; and transferring the pigmented areas to a copy sheet to form a composite of the image area and patch area.

In yet another aspect of the invention, method and apparatus for production of copy by electrostatic recording is described by producing a charge on a recording element that is modulated with image information; developing an area of the element that is modulated with image information with a non-magnetic pigment; producing a charge on a second area of the recording element for recording character information; developing the second area of the recording element with a magnetic pigment; transferring the pigmented areas to a copy sheet to form a composite of the image area and the character information area, the character information area being covered with the magnetic pigment to enable same to be machine readable by a magnetic reader.

DESCRIPTION OF THE PREFERRED EMBODIMENTS

Figure 1:
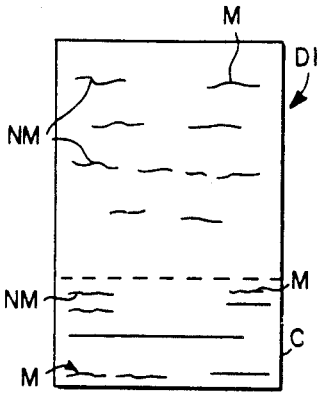
FIG. 1 is a sketch of one type of document produced by the method and apparatus of the invention.

With reference now to FIG. 1, a document D that may be made using the method apparatus of the invention is illustrated and may be a financial statement from an insurance company, bank or brokerage wherein the statement includes visible indicia NM formed with non-magnetic toner and a check portion C having required bank clearing character indicia and other known indicia M formed with magnetic toner. The bank clearing indicia is of the type that can be machine readable by well-known magnetic character readers. Other information in this machine-readable form may be provided on check portion C which identifies the check with machine readable data M on the other portion of the statement.

Figure 2:
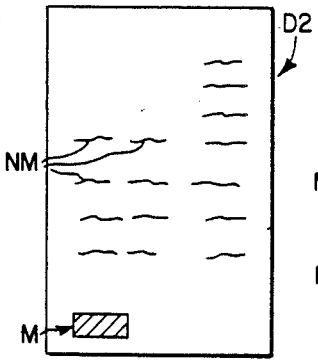
FIG. 2 is a sketch of a second type of document produced by the method and apparatus of the invention.

With reference now to FIG. 2, a second type of document D2 produced using the method and apparatus of the invention includes indicia formed with non-magnetic toner and a visible area having a patch formed with magnetic toner. The patched area is magnetized as a bar code. The bar code may be used to identify the document or include otherwise machine readable data.

Figure 3:
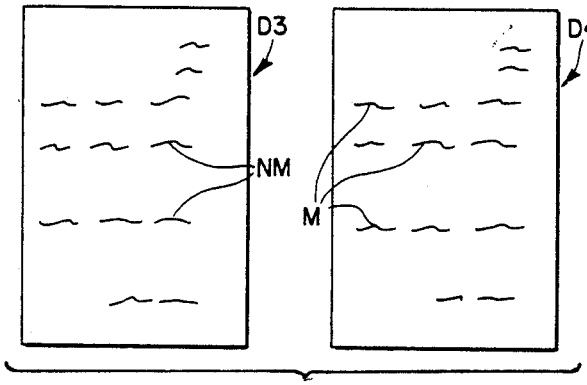
FIG. 3 is a sketch of two other documents produced by the method and apparatus of the invention.

In FIG. 3, two documents D3 and D4 are shown. Document D3 is formed with indicia NM using non-magnetic toner only and document D4 is formed with indicia M using magnetic toner only. A document formed say with all its indicia in magnetic toner may be useful in preparing confidential documents wherein copiers in an office are adapted to copy such documents only under proper authorization.

Figure 4:
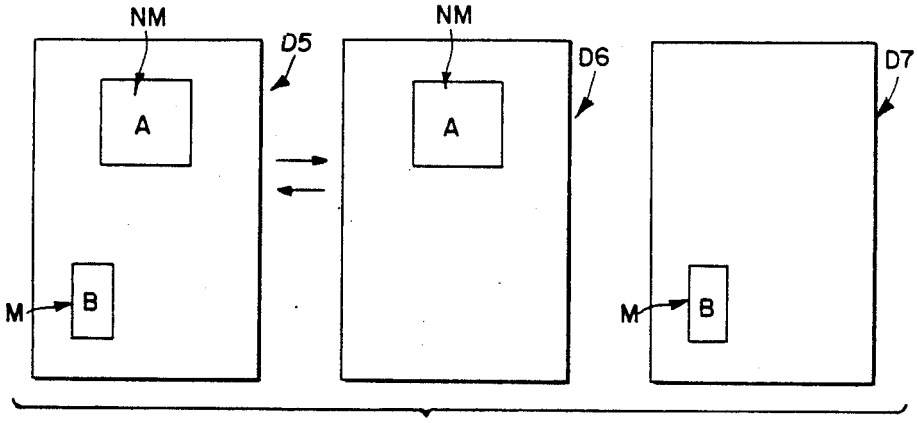
FIG. 4 is a sketch of still other document types produced by the method and apparatus of the invention.

In FIG. 4, a document D5 is illustrated which includes one area A formed with indicia using non-magnetic pigment or toner NM and a second area B formed with indicia using magnetic toner M. Document D5 may be used as an original for forming either or both of two types of reproductions represented as D6 or D7. In addition, documents having the characteristics of documents D6 and D7 may be used to reproduce a composite document like D5. As can be seen from FIG. 4, document type D6 contains an image area A formed with non-magnetic toner.

Figure 5B:
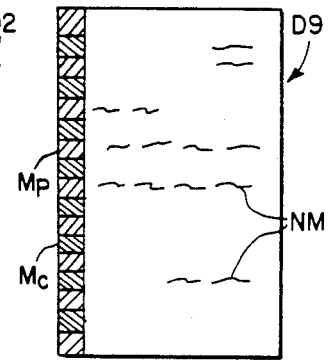
FIGS. 5*a* and 5*b* are sketches of further types of documents produced by the apparatus and methods of the invention.
Figure 5A:
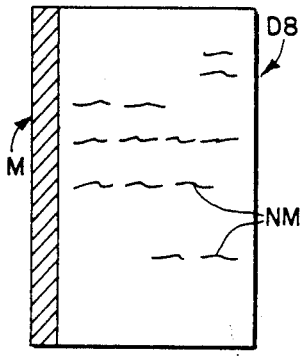

In FIG. 5*a*, a document D8 is illustrated, the document includes an area of indicia formed with non-magnetic toner and a second area at or adjacent a binding margin that is formed with magnetic toner.

In FIG. 5*b*, a document D9 is illustrated; the document includes an area of indicia formed with non-magnetic toner, and at an area at or adjacent a binding margin, an arrangement of different types of magnetic toners.

Discussion will now be made with regard to the embodiment of the invention illustrated in FIG. 6 where a schematic of an electrophotographic reproduction apparatus is shown. The apparatus 10 includes a closed loop, flexible image transfer member, or photoconductive web 12. The web 12, is supported on rollers 14, 16, 18 and 20. The rollers are mounted on the apparatus' frame (not shown) with one of the rollers, for example, roller 20, rotatively driven by a motor 22 to effect continuous movement of the web 12 in a clockwise direction about its closed loop path. The web has a plurality of sequentially spaced, nonoverlapping image areas which pass successively through electrophotographic processing stations (charge, expose, develop, transfer, clean) located about the path of the web. The web also includes timing marks (or regularly spaced perforations) which are sensed by appropriate means, such as timing signal generator 24 to produce timing signals. Such signals are sent to a computer controlled logic and control unit (LCU) 31. The LCU 31 controls the entire electrophotographic process based on the instantaneous location of the web in the travel path. An encoder 28 associated with the roller drive motor 22 also produces timing signals for the LCU. The signals from the encoder cause the LCU to fine tune the process timing. The LCU 31 has a digital computer, preferably a microprocessor. The microprocessor has a stored program responsive to the input signals for sequentially actuating, then deactuating the work stations as well as for controlling the operation of many other machine functions.

Programming of a number of commercially available microprocessors such as one or more INTEL model 8086 microprocessors (which along with others can be used in accordance with the invention), is a conventional skill well understood in the art. This disclosure is written to enable a programmer having ordinary skill in the art to produce an appropriate control program for the microprocessor(s). The particular details of any such program would, of course, depend on the architecture of the designated microprocessor.

Figure 7:
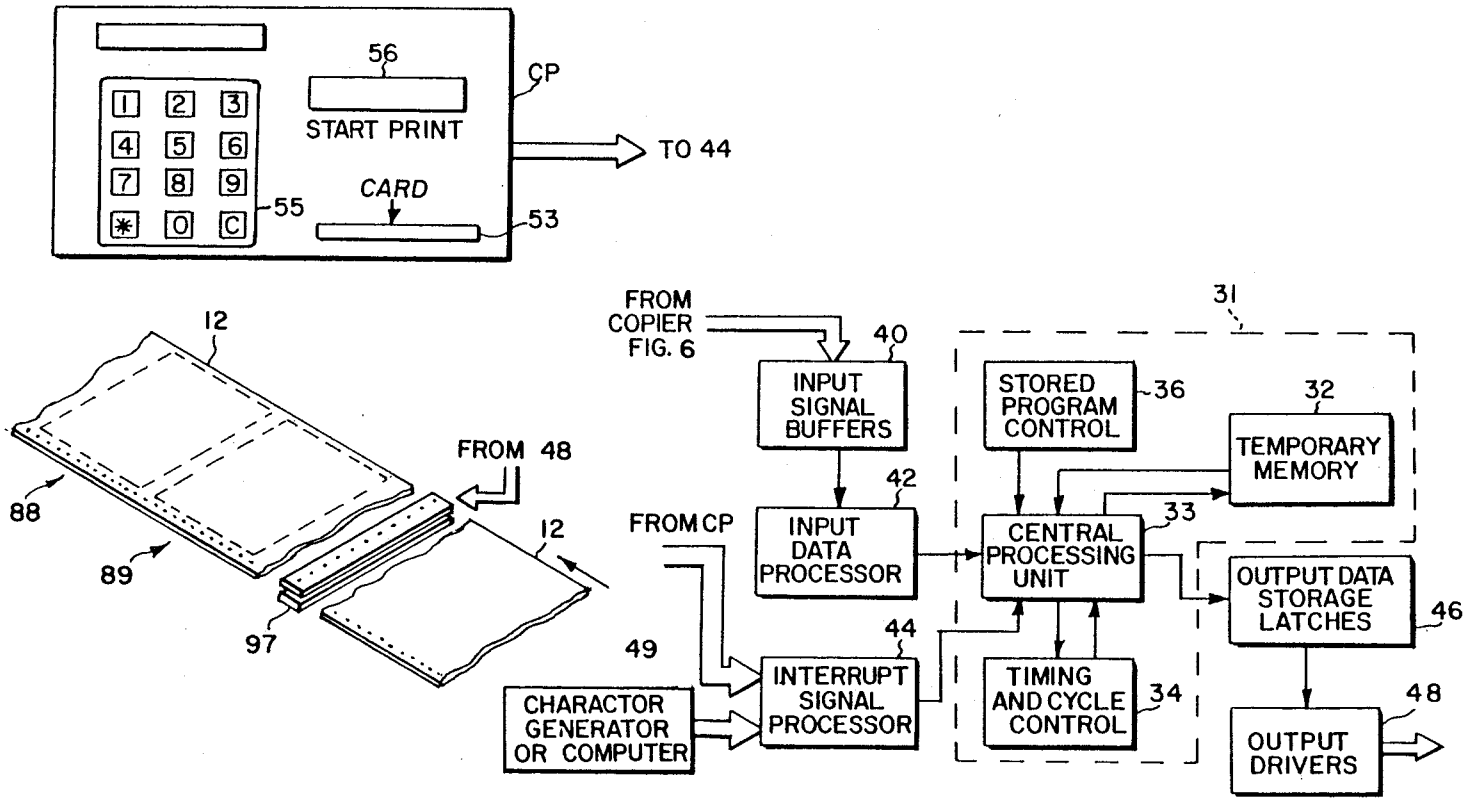
FIG. 7 is a schematic of apparatus and a control system for use with the invention.

With reference also now to FIG. 7, a block diagram of logic and control (LCU) 31 is shown which interfaces with the apparatus 10. The LCU 31 consists of temporary data storage memory 32, central processing unit 33, timing and cycle control unit 34 and stored program control 36. Data input and output are performed sequentially under program control. Input data are applied either through input signal buffers 40 to an input data processor 42 or to interrupt signals processor 44. The input signals are derived from various switches, sensors and analog-to-digital converters. The output data and control signals are applied to storage latches 46 which provide inputs to suitable output drivers 48, directly coupled to leads. These leads are connected to the various work stations, mechanisms, and controlled components associated with the apparatus.

Figure 6:
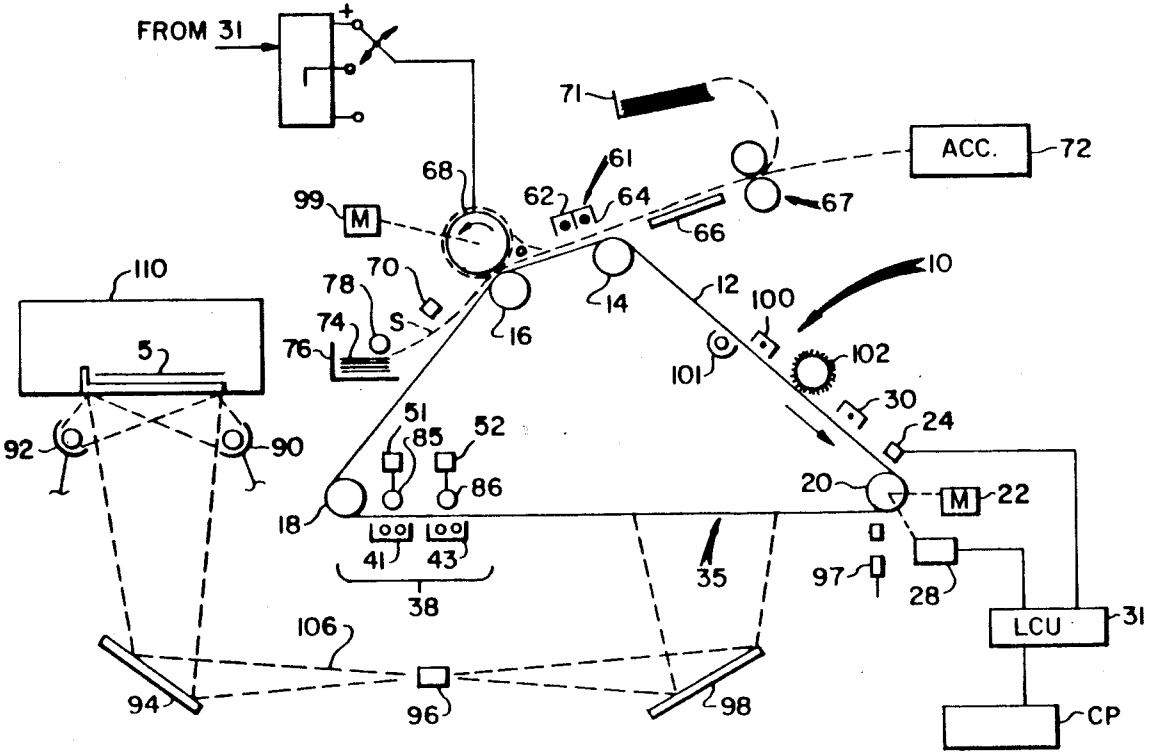
FIG. 6 is an elevational view in schematic of one embodiment of apparatus of the invention.
Figure 8:
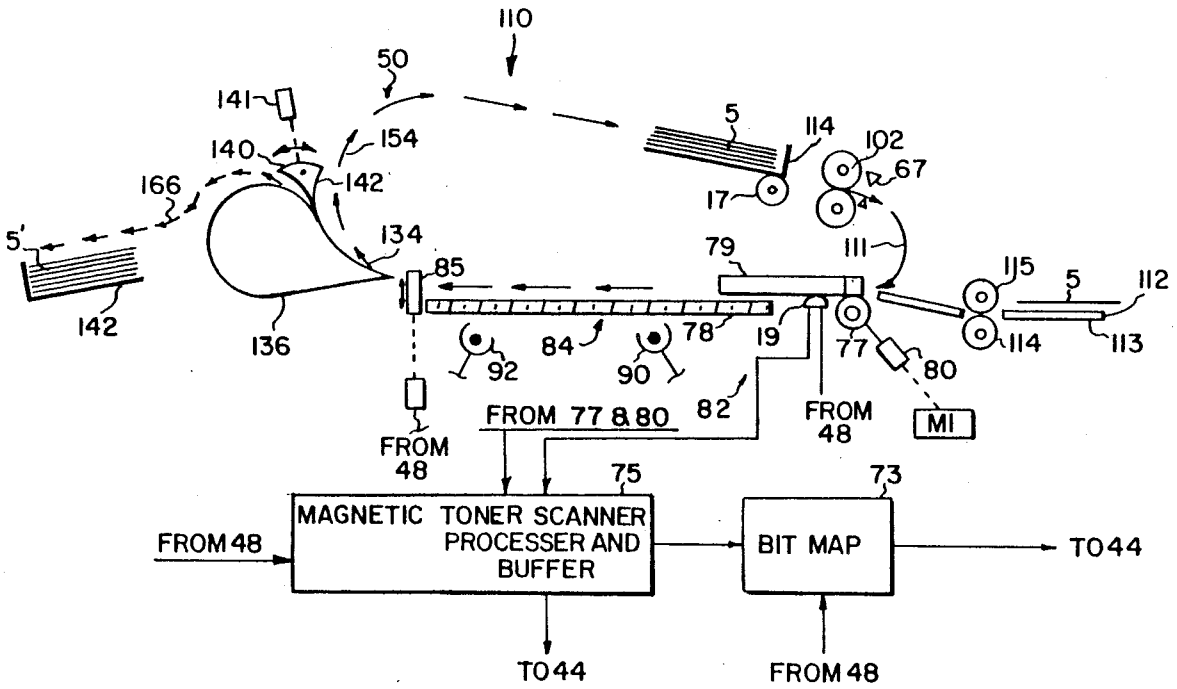
FIG. 8 is a view of a document positioner and recirculating feeder for use in the apparatus of FIG. 6.

As may be noted in FIGS. 6 and 8, the document sheet feeding apparatus includes a recirculating feeder 110 and document positioner 112 for serially feeding sheets 5 of original documents past a document magnetic detection unit 19 to the exposure platen 84. In one mode of operation of the apparatus 10, the document sheets 5 of a multisheet document are positioned in the tray 114 with the information to be copied facing upwardly, with the document sheets in their normal order, and with the topmost sheet being the first sheet of the document. A rotatable solenoid 141 which is connected to a sheet diverter 140 is energized in response to a signal from the LCU, the lowermost document sheet is withdrawn from the bottom of the stack in the tray 114 by means of an oscillating vacuum device 17 or other feeding device and fed through the path shown by the arrow 111 and onto the exposure platen 84. Block or registration gate 85 stops and registers the document sheet at the exposure platen. After a document sheet is illuminated by platen exposure lamps 90, 92 (as will be described below), the block is withdrawn (by conventional means not shown) from the path of travel and the document sheet is then driven from the platen in the direction indicated by the arrows 134, 154 back onto the top of the stack of document sheets in the tray 114. This cycle continues until the required number of collated sets of copies has been made, as determined by a set counter (not shown) in the LCU. FIG. 8 also illustrates the second mode of operation which uses the document positioner 112. When document sheets are to be copied by means of the document positioner 112, a document sheet is fed across tray 113, into the nip of rotating rollers 114, 115 which feed it to document metering roller 77. The metering roller is actuated to feed the document sheet and deliver it to the platen where it is registered by the block 85. After one or more copies of the document sheets are made, the block is raised and the drive rollers (not shown) drive the document sheet from the platen along the path indicated by arrows 134, 166. In this second mode, the solenoid 141 is de-energized and sheet diverter 140 is rotated counterclockwise to a position guiding the document sheet along the path 166 and the document sheet is delivered to a tray 142. Although the operation of the document positioner has been specifically described in connection with the copying of simplex original documents, it will be apparent that duplex documents can be copied by operating the apparatus as described in U.S. Pat. Nos. 4,176,945 and 4,451,137.

Further description of the apparatus of the invention will now be made with reference to reproduction of documents in an office where documents that are confidential may not be reproduced without authorization while documents that are confidential may be reproduced without authorization.

Figure 9:
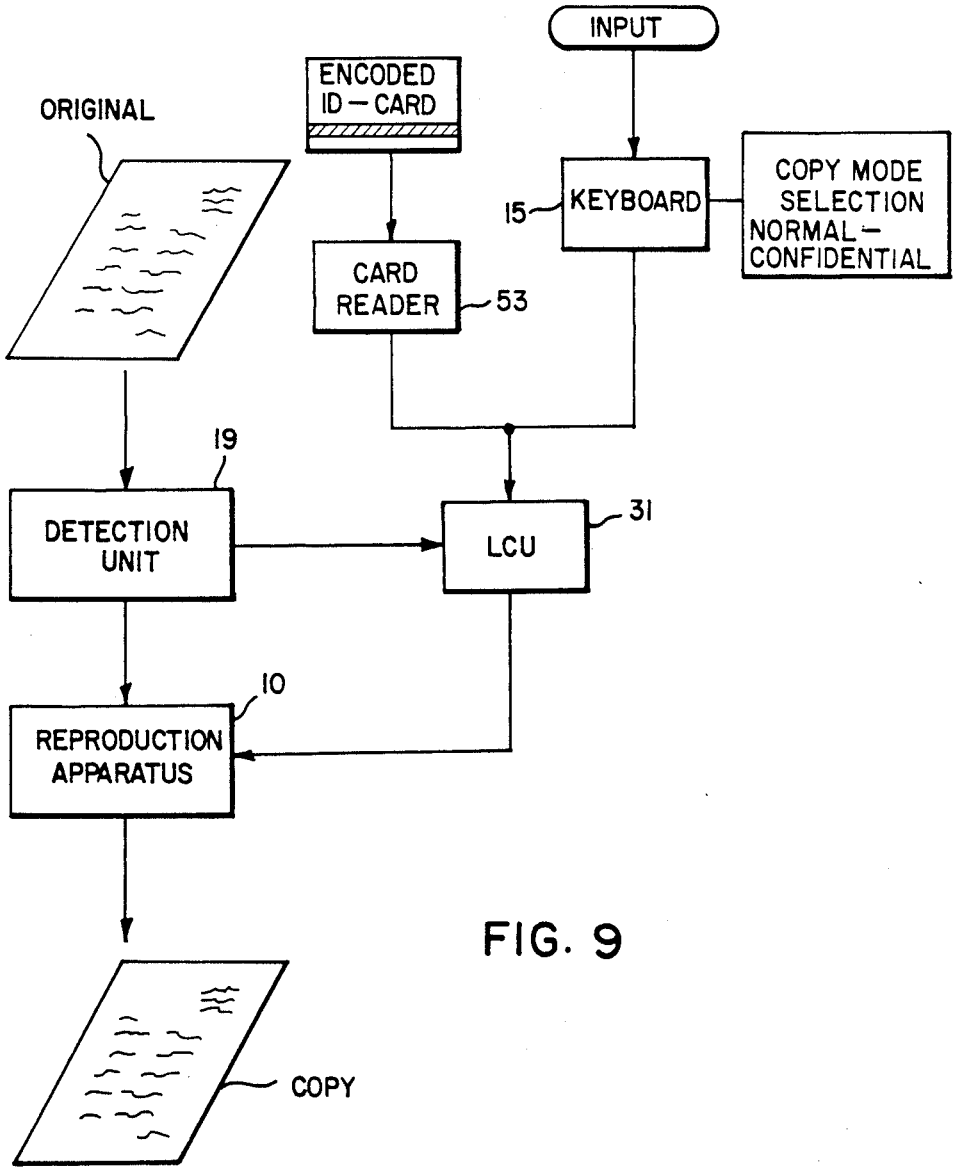
FIG. 9 is an illustrated flowchart describing one aspect of the method and apparatus of the invention for controlling the production of secure documents.

With reference now also to FIGS. 3 and 4, assume that an original confidential document is prepared using a non-magnetic ink. In order to ensure that copies cannot be made of same within the office or building holding same, all copiers are provided with a detection unit as described herein. The confidential document may comprise a multisheet document set and is placed in the recirculating feeder 110. Alternatively, originals may be copied by presenting them to the document positioner 112. The authorized operator then selects a "create confidential document" reproduction mode (see FIG. 10) by selecting an appropriate button on the copier's operator control panel (CP) or a keyboard 15 (FIG. 9). In this mode, reproductions of the document will be made using MICR or magnetic toner so that in the future, copying operation reproductions of such document may be controlled.

As noted above, during each of the two different feed modes, the original document sheet 5 is oriented image side down, on transparent glass platen 84 that is supported by the copier frame. Exposure lamps 90, 92 such as xenon flash tubes, are located beneath the platen 84 within the frame. The lamps flood the document sheet with light and a reflected image of the document sheet is transmitted via mirror 94, lens 96 and mirror 98 in focus to an area 35 representing one image frame lying in the plane of the web 12. The timing of the flash of lamps 90, 92 is controlled by the LCU and related to the travel of the web 12 to expose adjacent, nonoverlapping areas of the web to the images of the document sheet. One or more corona charging units, exemplified by corona charger 30, is located upstream of the exposure area 35, and applies a uniform primary electrostatic charge, of say negative polarity, to the web 12 as it passes the charger and before it enters the exposure area. The photoconductive properties of the web cause the primary charge in the exposed areas of the web to be discharged in that portion struck by the exposure light. This forms latent imagewise charge patterns on the web in the exposed areas corresponding to the image on the document sheet.

In this mode, all reproductions are made using toning station 41 and no reproductions are made if the original is detected to have no magnetic permeability or remanent magnetization. Toning station 41 is provided with a magnetic toner such as, for example, those called MICR toner which is a known magnetic toner used for producing bank checks or the like so that the information thereon can be read by magnetic readers. Document reproduction is made by feeding the documents seriatim to the exposure platen, exposing each one in turn to a respective image frame on web 5 and actuating development using station 41 containing MICR toner. Selective activation of a back-up roller 85 by solenoid actuator 51 in response to a signal from LCU 31 alters the path of web 5 into engagement with the toner of station 41 to cause development of the image frame. The toned image frame is then transferred to a copy sheet S as indicated above and the image fixed by fuser rollers 67 and collected in tray 71. The photoconductor is cleaned and otherwise prepared for reuse at a cleaning station using, for example, rear erase lamp 101, neutralizing charger 100 and cleaning brush 102. The document set reproduction now produced is capable of being detected by the detection apparatus of the invention as will be described and the original may now be destroyed.

Assume now that someone wishes to copy a confidential document that has magnetic content. The document set to be reproduced is placed in the recirculating feeder or document positioner. He/she then verifies authorization to make copies of confidential documents by placing his/her card in the card reader 53 (FIG. 9) and inputting a personal identification code via the keyboard 15 that also forms a part of the copier. The normal copy mode is then selected by the operator or operates automatically as a default in the event a copy start button (56) is pressed. The inputs from the card reader and the keyboard are compared by the LCU 31 and a decision is made as to whether or not this individual is authorized to copy confidential documents. If this decision is no, the copy sheets are fed seriatim to the exposure platen. For each document the presence of magnetic permeability content or reminant magnetization therein will be sensed by the detection unit 19. The detection unit may comprise a magnetizing head, such as a recording head or bar magnet, and a sensor or read head that reads the remanent magnetization or another device that senses magnetic permeability. The output of the detection unit is fed to LCU 31 via interrupt signal processor 44 which determines the nature of the document and whether or not the person requesting the copy is authorized to reproduce same. If the document is confidential and the requester authorized, a copy is made using station 41 containing MICR toner. If the requester is not authorized, no copy of that document is made and the next document is fed to the platen. A log may be kept by the LCU of all attempts to copy confidential documents by unauthorized users. This next document, if confidential, also will not be copied. If, however, this document is not confidential (no magnetic content), it will be copied using toning station 43 which includes non-magnetic toner. In this regard, back-up roller 87 is actuated in response to solenoid 57 to move the web 5 into engagement with the toner of station 43. Thus, a mixed set of originals can be placed in the feeder and the apparatus will determine which documents to copy in accordance with the authorization provided to the requester. Note that the magnetic permeability content of an original may be provided by use of magnetic ink from typewriter ribbons, stamp pads, stickers, etc. in addition to toners as described herein, and other toners besides MICR that may comprise metal dust such as iron dust.

The LCU may control this selective copying by inhibiting copying altogether such as by not energizing the lamps 3, 4 and/or operating a shutter within lens 96 when authorization for copying a confidential document is not proved during a request for a normal mode of copying. Still another way of inhibiting copying may be provided by turning on an erase lamp or electro-optic printhead such as an LED printhead or other device to erase all charge from the image frame.

In the above description of the secure copier, assumption is made that all copies must be fed past the magnetic detector 19 and thus the feeder cover is locked in position and may not be lifted for making a copy in say a book mode unless perhaps by an authorized user. In the event it is desired to have a secure copier for copying say a book where the recirculating feeder cover must be lifted for copying in a book mode, reference is made to the invention described in the application referred to at the beginning of this application, the contents of which application are incorporated herein.

In a modification of the above apparatus and method, the secure documents are provided with their respective visible indicia formed with a magnetic pigment. Furthermore, the areas of each document are magnetized in a code that can be read by the detection unit and compared with a code stored in the LCU 31. Stated otherwise, a secure document has all or most of its visible information formed with a magnetic pigment. The secure document is then passed through a magnetic recorder that impresses the visible magnetic pigment into a magnetic bar-like code. A document detected as having this code may be considered a secure document. This type of document would be particularly useful in a copier where only secure copies can be made and in order to affirm the status of the document as a secure copy, the document must have the coded attribute.

Figure 10:
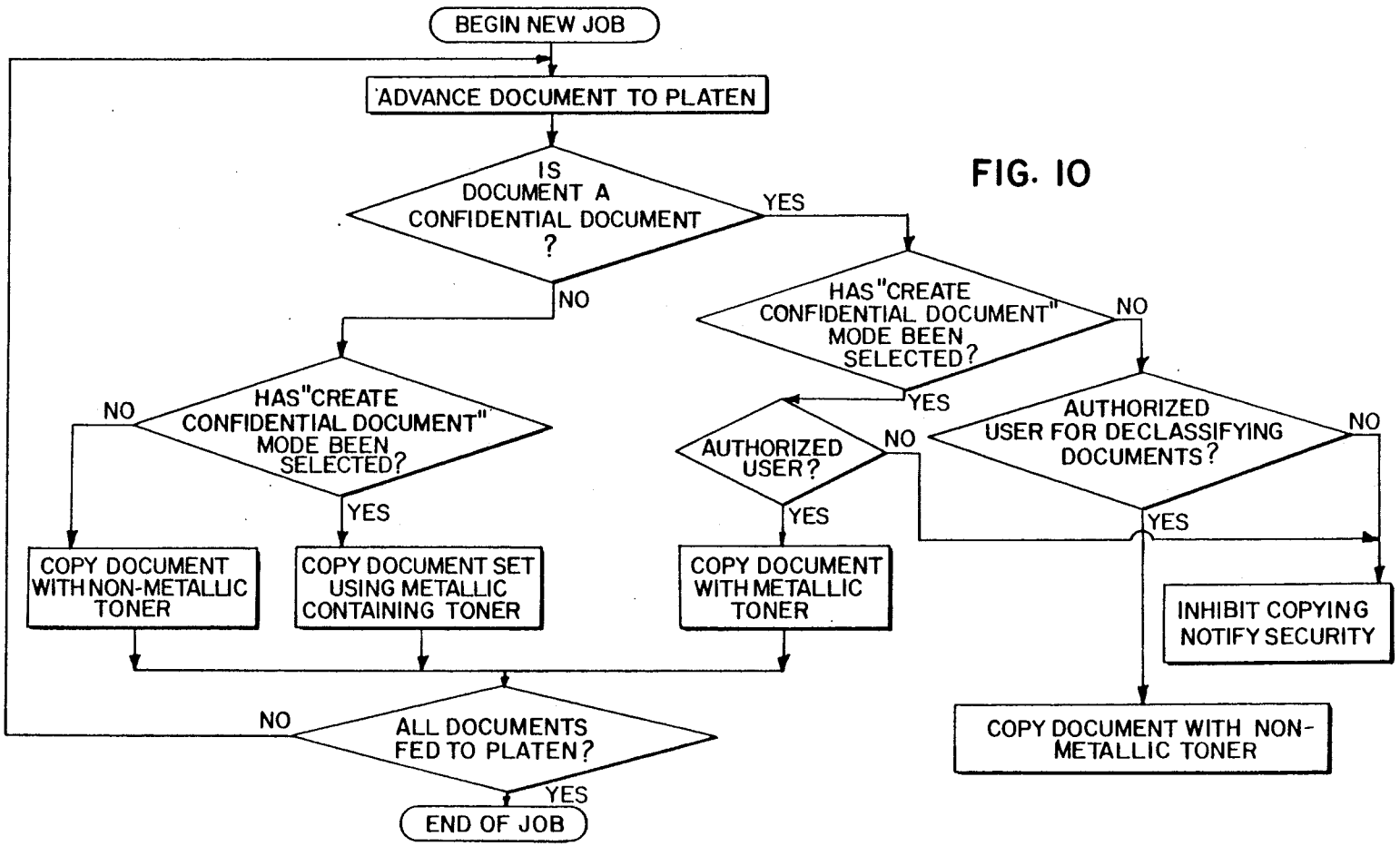
FIGS. 10–17 are flowcharts describing reproduction operations in accordance with the methods and apparatus of the invention.

In the following description, the assumption is made that the copier apparatus is programmed to be operable in modes other than that taught in the flowchart of FIG. 10 by a suitable authorized individual(s).

Figure 11:
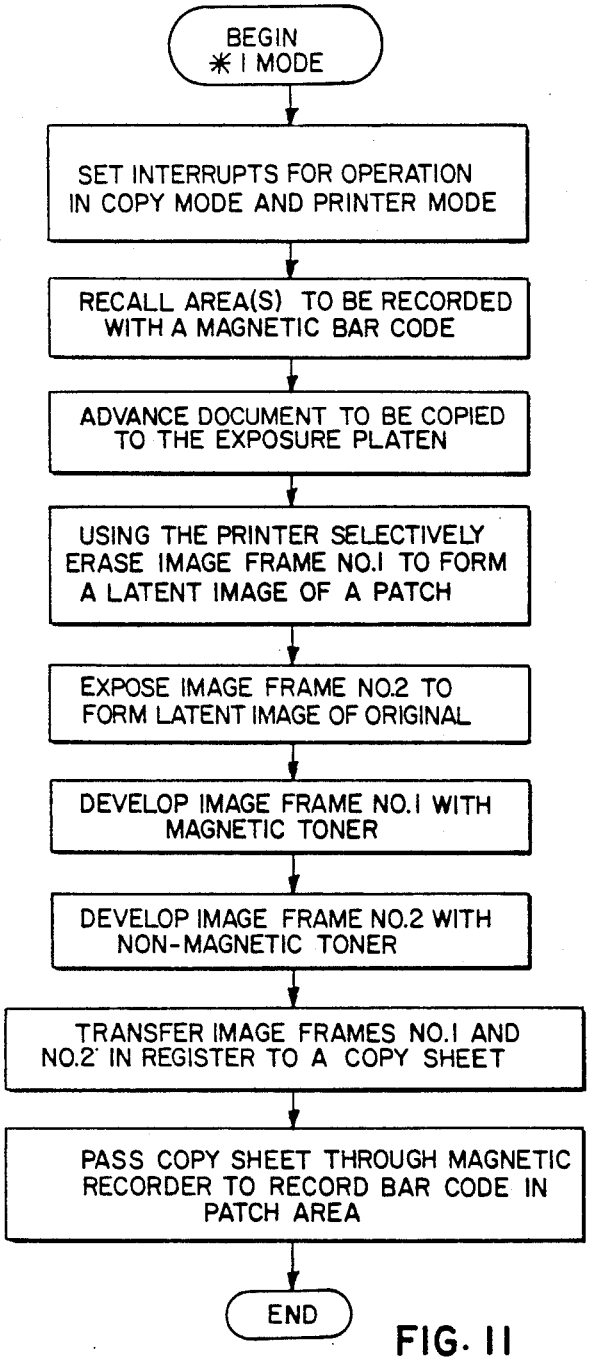

Description will now be provided for reproduction of the document type illustrated in FIG. 2 wherein a document original includes say non-magnetic indicia NM but it is desired to add a magnetic bar code to the document to identify the document by machine retrieval. Consider also in this example that a group of documents of this type is to be prepared from a set of originals placed in the recirculating feeder or otherwise fed seriatim from the document positioner. With reference to the flowchart of FIG. 11, the operator through a code input via operator control panel (CP) key pad 55 calls up a program stored in the computer's stored program control for creation of such documents. In this example, the code is say, *1. After also pressing the start print button 56, the documents are then fed serially past the detection unit onto the exposure platen 84. The documents are serially exposed by the exposure lamps 90, 92 and each imaged upon an appropriate image frame 89 of photoconductor 12 to form a latent electrostatic image of the document thereon. Prior to an image frame being exposed, an electronic exposure source such as an LED printhead 97 is enabled to erase charge from an adjacent image frame 88 in all areas of this frame except for an area where the magnetic bar code is to be formed. The identification for this area may be stored in temporary memory 32 in response to inputs provided previously by the operator such as by key pad 55 to identify the coordinates of the location of this area or by other means such as known digitizer devices. This adjacent image frame is then developed using the magnetic toner station 41 to form a patch-like toned image on this image frame. As the image frame which is to receive the optical exposure passes above the LED printhead, the area on this image frame corresponding to that where the bar code is to be located may also be erased of charge by selective activation of the light-emitting diodes in the printhead 97. The image frame exposed to the document D2 is then also developed but with non-magnetic toner from station 43 and the two-image frames transferred in register to a copy sheet S. Solenoids 51, 52 selectively move respective backup rollers 85, 86 into contact with the web 12 to deflect the web from its travel path into operative engagement with respective development stations for development of respective image frames. The charged toner particles in the respective stations are attracted to the oppositely charged latent imagewise patterns to develop the respective charge patterns.

The logic and control unit 31 selectively activates each solenoid in relation to the passage of an image frame that is to be processed with the respective type of toner. Where the first image frame is to be developed with magnetic toner and the second image frame is to be developed with the non-magnetic toner the image frame containing the image to be developed with the magnetic toner reaches the development station 41, solenoid 51 moves the backup roller 85 to deflect the web so that the latent charge image is developed by attracting magnetic toner particles from the station 41. As soon as the image area leaves the effective development area of the station 41, the solenoid 51 returns the backup roller 85 to its nondeflecting position. A similar cycle is accomplished by the logic and control unit 31 for the development of the second image frame or sector containing only the optical exposure of the document D2. In this regard, solenoid 52 and back-up roller 86 are employed to develop this frame with non-magnetic toner from station 43.

The developed magnetic and non-magnetic toned image frames must be transferred to a receiver sheet in accurately registered superimposed relation to form a reproduction of the original document sheet having both the information of the original and a patch area of magnetic material that may be later magnetized to form the bar coded information. Apparatus for providing such registered transfer are fully described in U.S. Pat. Nos. 4,477,176issued Oct. 16, 1984 and 4,251,154, issued Feb. 17, 1981 in the name of Matthew J. Russel, the contents of which are incorporated herein by this reference. Briefly, this is accomplished by feeding a receiver sheet or support S of say plain paper, from a supply stack 74 stored in hopper 76, in sychronism with movement of the first image frame so that the receiver sheet engages the web in register by mechanism 70 with the first image frame. A transfer roller 68 includes a compliant insulating surface thereon and is biased to a potential suitable for transfer of the developed image on the first image sector to the receiver sheet S and to tack receiver sheet S to roller 68. Roller 68 is driven by a stepper motor 99 which receives actuating signals from the LCU 31.

Roller 68 may also be a biased vacuum roller or a roller with sheet clamping mechanisms to clamp the sheet to it.

Continued movement of web 12 and synchronized rotation of roller 68 brings the lead edge of the copy sheet back into transferable relationship with the web as the lead edge of the next toner image arrives at roller 68. At this point, the bias on roller 68 is reversed to repel sheet S away from roller 68 back into contact with web 12. Receiver sheet S will be carried by web 12 so that the receiver sheet is in registration with the image on the second image frame. This image is transferred to the receiver sheet by charger 61 including transfer charger 62 and detack 64. The copy sheet is separated from the web and conveyed by either vacuum transport or as shown air transport 66 to roller fuser 67 and then to exit hopper 71 or an accessory finishing unit 72. The use of the recirculating feeder as described above will provide for collated sets of copies where the multisheet document is arranged in collated order in tray 114 with the first sheet at the top and wherein the sheets are fed one at a time from the bottom beginning with the last sheet in order of collation and returned back to the top. Depending upon the number of collated sheets desired, each sheet will be recirculated once for each such copy set. The copies made thus comprise a copy of the original with a patch area formed of magnetic toner.

After the copies are made, the recirculating feeder may be used in conjunction with the detection unit 19 which includes a magnetic read/write unit to record bar codes in the patched area of each reproduction. Each set of reproductions is placed in the recirculating feeder and the read/write unit 19 activated into its write mode to record the bar code as the document sheets are advanced from the bottom of the stack and circulated past the write head to the top of the stack. For example, the documents may be bar coded with a code that serially numbers them. This can be done by either the operator indicating the number of documents in the set or by circulating them through the feeder to count or by remembering the number from the copying process. Thereafter, the bottom document is fed and its patched area magnetically bar coded with the proper code and so on.

The advantage of the bar code described is that the code is magnetic and not visible. Of course, if desired a visible bar code may be produced by imaging same on the image frame that is developed with the MICR toner. In such a case, no need to separately encode the bar code is required since such bar code is magnetizable with a DC field and is detectable or readable by magnetic reader units. If a patch area is formed with high coercivity magnetic toner on a sheet and it is desired to impress a non-visible magnetic bar code on the document (such as used in credit cards) that is unerasable, there may be a need for a high field strength write head. The write head used for such may be separated from the detection unit or this operation perfomed on another device off-line. The advantage of the "unerasable" bar coding is that when these documents are again circulated for reproduction through the apparatus of the invention, the detection unit will not cause erasures of the bar code on these new originals. The "unerasable" codes referred to herein require relatively high magnetic fields to change the existing magnetization.

Figure 12:
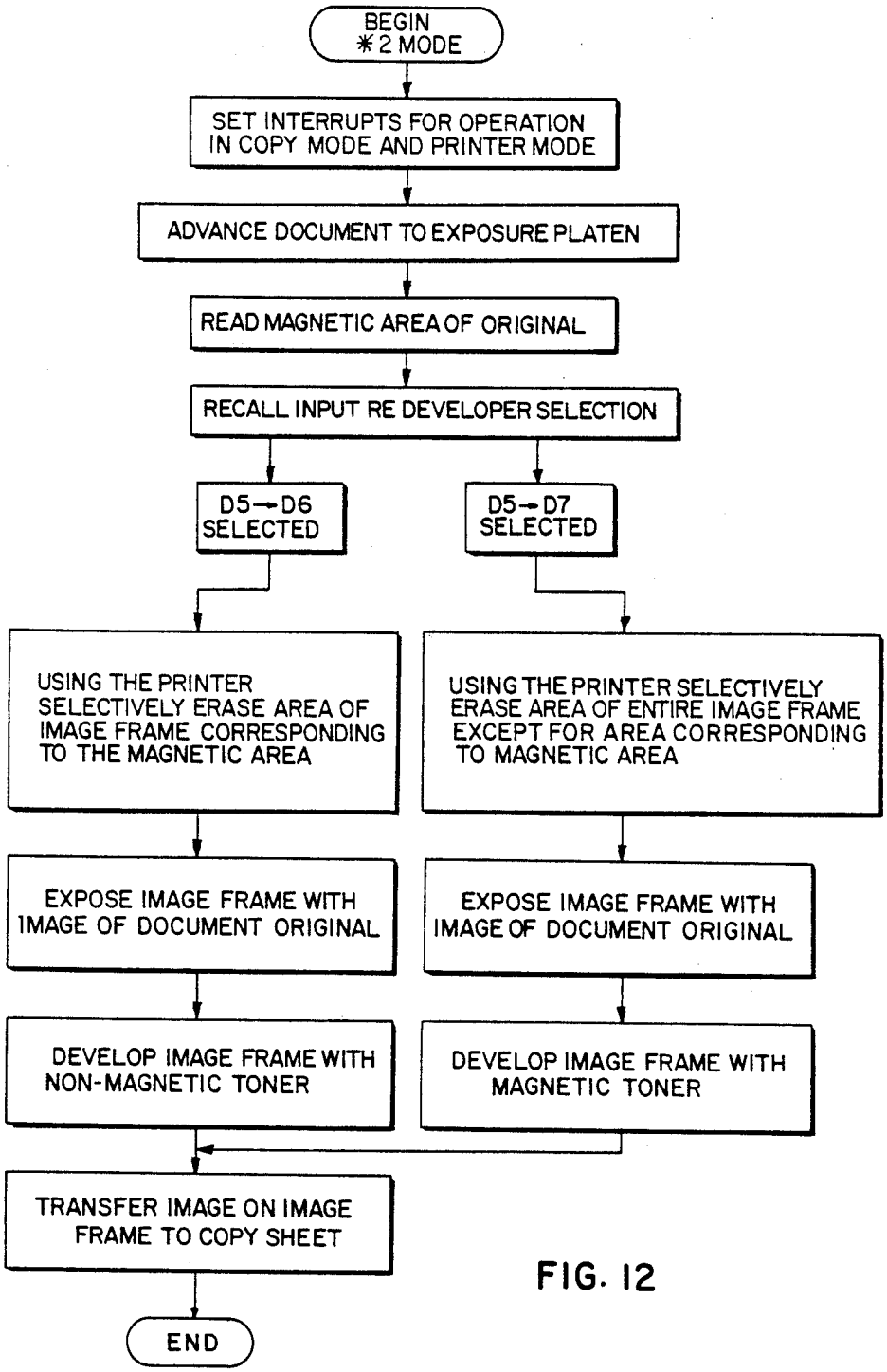
Figure 13:
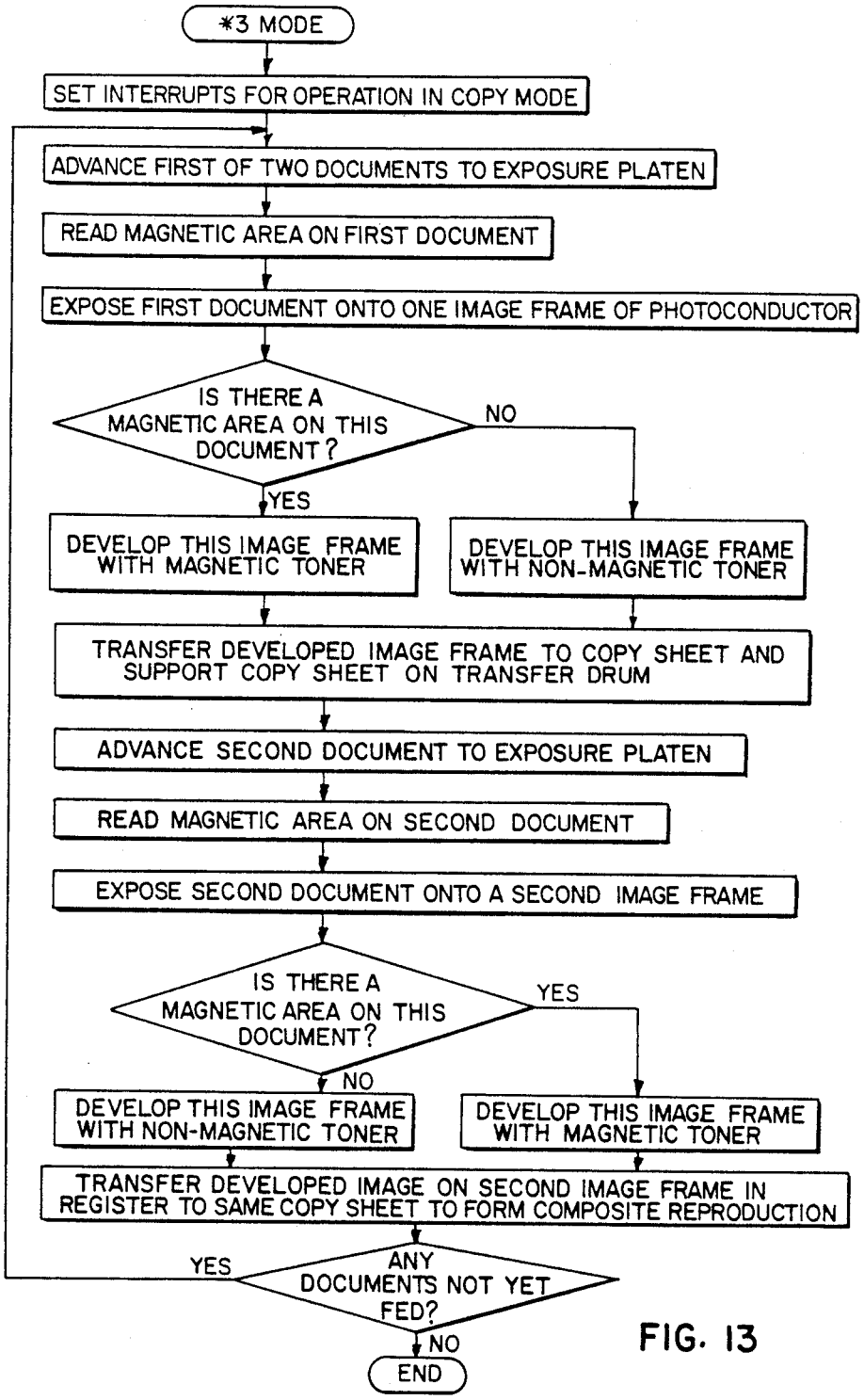
Figure 14:
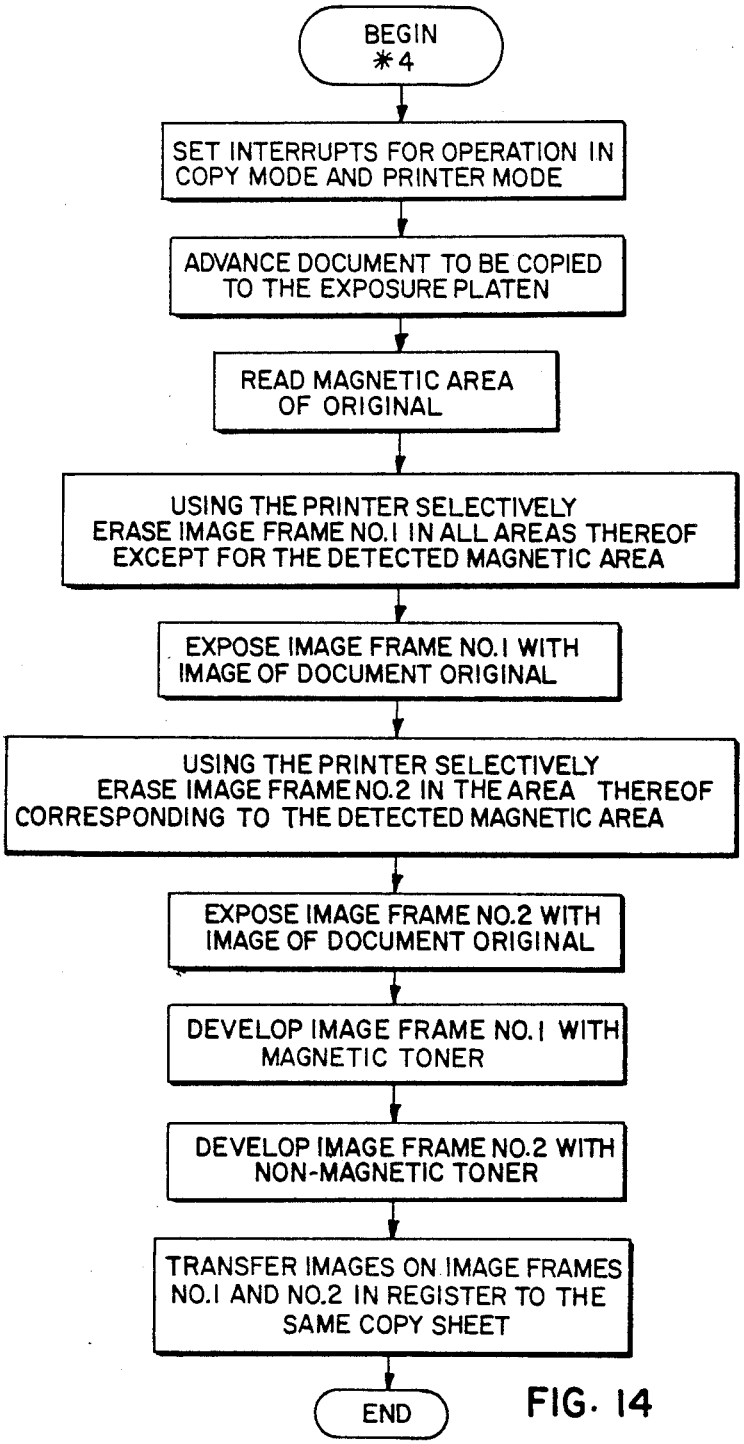

Description will now be provided with regard to reproduction of the document types illustrated in FIG. 4. Assume that a document type D5 is situated in a stack of documents only some of which have information portions thereof recorded with magnetic toner and other information portions recorded with the non-magnetic toner. Such might be the case where documents are prepared having confidential and non-confidential portions and it is desired say to reproduce the non-confidential portion for mailing to a client or customer. Alternatively, the document may be the document D2 and it is desired to reproduce same without the bar coded patch. With reference to the flowchart of the FIG. 12, a code say *2 is input from the control panel and in response to the start of the copying operation, the documents are fed seriatim from the recirculating feeder past the magnetic reader detection unit 19. Documents not having magnetic indicia and content are exposed at the exposure platen and reproduced by the apparatus in a normal copying mode. When a document such as document type D5 is detected by the detection unit, the detection unit reads the area of the document which contains the portion recorded with magnetic toner. This area is defined with reference to an edge of the document that is sensed by an edge sensor that determines the size of the document sheet. The edge of the document may be sensed, for example, when the document moves into metering roller 77 which is spring biased against back plate 79. The initial displacement of the metering roller from the back plate upon entry of the leading edge may be sensed by closure of a microswitch (not shown) and used to generate a pulse to the LCU. Rotation of the metering roller then determines dimension information. The height of the sheet may be determined by edge guides in the feeder that are adjusted by the operator against the top and bottom of the sheet. Sensors not shown detect this dimension and conveys same to the LCU. The image on the image frame is then transferred to a receiver sheet S to form a reproduction of a document type designated D6 in FIG. 4. Thus, a relationship can be established between the location of an edge or corner of the document and the location of the area containing magnetic indicia. The coordinates of the area containing magnetic indicia are processed by a processor and buffer 75 and the processed data stored in say, a bit map memory 73. These signals represent data for driving the LED printhead for selective erase of areas not to be reproduced on the image frame. As the image frame that will be used for recording this reproduction is driven above the LED printhead 97, the printhead is activated in response to the signals stored in the bit map memory to erase charge from that area corresponding to the area having the magnetic toner. Thereafter, the image frame passes into the exposure station and the LCU provides signals to activate the exposure lamps 90, 92 to reproduce the document which is now on the platen. The LCU then actuates the backup roller to cause development of the image frame with non-magnetic toner stored in the development station.

In a similar manner, reproductions D7 having just the confidential area may be reproduced by providing the inverse bit map to that indicated in the above paragraph so that the LED printhead erases charge from all areas of the image frame except for that corresponding to the location of the magnetic area on the original. Then when the document is exposed, only the area on the image frame corresponding to that of the magnetic area on the original can be developed and transferred to a receiver sheet. The reproduction can be developed with either magnetic or non-magnetic toner but if the security of the document is to be retained in accordance with the scheme suggested above, then the document is reproduced in magnetic toner.

As noted by the arrows in FIG. 4, a composite document D5 may be formed from separate documents D6, D7 by sequentially feeding these documents past the magnetic detection unit. In this regard, a new program mode *3 may be called up which will activate the feeder to serially feed two documents from the stack of documents into the feeder. The two documents are sequentially exposed at the exposure platen onto adjacent image frames. The image frames are developed one with non-magnetic toner, the other with magnetic toner in accordance with which document was sensed as having magnetic indicia. The two developed image frames are then transferred in register to a copy sheet as described above and a reproduction D5 having magnetic and non-magnetic portions is provided.

With reference now to FIG. 4, another copy mode is illustrated that may be called up by say a code *4. In this mode, an original document of the type as illustrated as D5 in FIG. 4 may be reproduced so that the reproductions are also of the document D5 type. After a start print signal is provided by pressing button 56, a document original is advanced from document positioner 112 or recirculating feeder 110. The document original enters metering roller 77 thereby locating the leading side edge thereof as described above. Note also as described above that the locations of the top and bottom edges of the document original are established by adjusting edge guides (not shown) in the feeders that determine the position of the edges as the document original is fed through the feeder. Upon passing over magnetic detecting unit 19, the location of area B comprised of information formed with magnetic pigment is established vis-a-vis an edge or corner reference of the document original. The signals of detecting of magnetic material are processed by processor and buffer 75 and a bit map is formed as described above in bit map 73 for driving printhead 97. A first image frame has its uniform charge modulated by printhead 97 by erasing charge from all areas thereof except for that corresponding to the detected magnetic area B. A second image frame is then erased of charge by the printhead in an inverse manner; i.e. the detected area corresponding to area B is erased of charge. When the document original is stopped on the platen 84 by block 85, the lamps 90, 92 are activated twice to expose an image of the document D5 onto the two image frames. The first image frame is developed with magnetic toner from station 41 and the second image frame developed with toner from station 43. The two image frames are then transferred in register onto a single copy sheet S using the transfer roller 68 and transfer station 61 as described above. The respective toner images are fused to sheet S by fuser rollers 67 and the sheet fed to tray 71 or finisher 72. The reproduction thus obtained is identical to original D5 having area A being formed with non-magnetic material and area B being formed of magnetic material.

With reference now to FIG. 5*a*, a page D8 is shown reproduced with non-magnetic indicia and a stripe portion M at or adjacent one edge that contains highly permeable magnetic toner. Each sheet of a multisheet document set may be formed in this way and can be bound at say this edge. This bound set or book then may be detectable when being removed from libraries or the like which contain suitable magnetic detection units to prevent theft of such books. Such a document can be produced using the apparatus of the invention in accordance with a special program called up by a code that is stored in permanent memory. In this program which is similar to that described in FIG. 11, the area of one image frame is selectively erased using the LED printhead so that charge remains on the image frame in an area thereof corresponding to where the stripe is to be reproduced, i.e., at the edge of the image frame corresponding to the bound edge of the reproduction. This image frame is developed with magnetic toner while the adjacent image frame is reproduced with non-magnetic toner after this latter image frame is exposed to the image of the original on the exposure platen. The two image frames are transferred in register to a single copy sheet in accordance with procedures as described above. The reproduction apparatus may have a conventional accessory unit 72 that binds the individual set of reproductions produced from the set of originals so that a bound set provides a secure book or pamphlet for use in libraries. The binding is made at the margin having the magnetic stripe.

Figure 17:
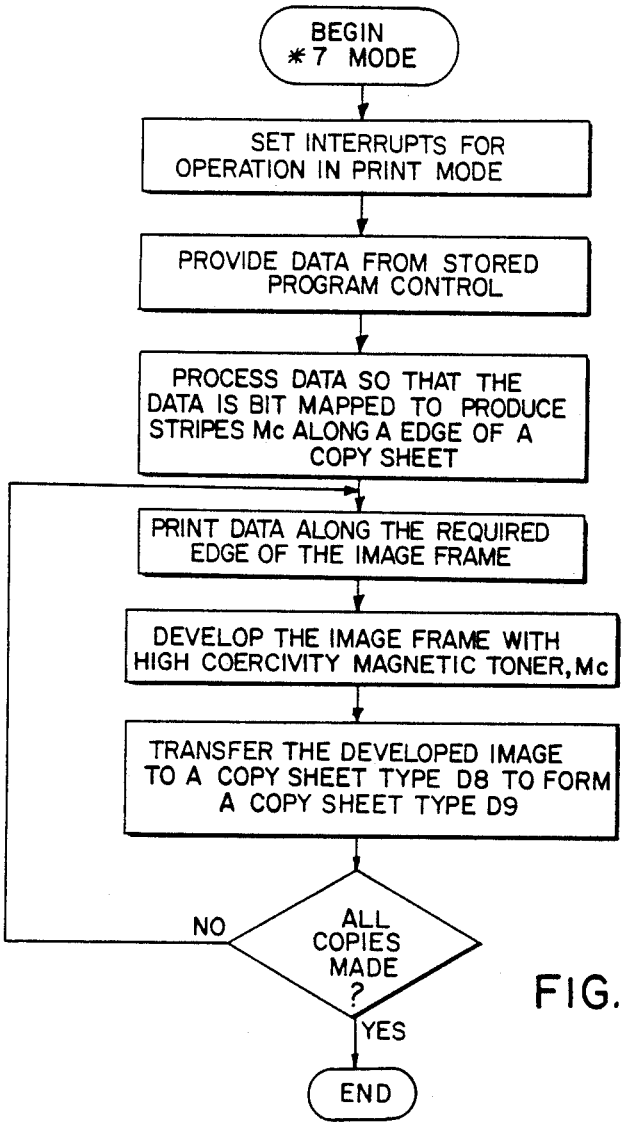

The above describes a secure book, such as a library reference copy, that can be detected during removal from the library. It is also desirable to provide for production of books and pamphlets that enable a book to be taken out from libraries in accordance with current library procedures. In a secure library, the books available for borrowing have a strip of magnetically permeable material with a series of higher coercivity stripe-like magnets overlying this material. Upon taking out a book, the librarian magnetizes the higher coercivity strips which saturate the magnetically permeable material and its permeability substantially decreases. When the book is passed through a sensor at the library exit, the permeability of the book cannot be detected due to this condition of saturation and no alarm or other signal is generated. In accordance with one aspect of the invention and with reference to document type D9 such a book may be created by first creating a set of documents type D8 which are to form the pages of the book or pamphlet. This magnetic toner developer station 41 is then replaced with a developer station having a magnetic toner Mc with a considerably higher coercivity than the magnetic toner indicated as Mp in FIG. 5*b*. The copy sheets of the D8 type are then placed in the paper supply tray 76. A print mode, say *7 (FIG. 17) is stored in stored program control memory and provides data that when printed by the LED printhead on each image frame appears like a series of striped areas Mc at the edge of an image area. These image areas are developed with the high coercivity toner and transferred to each type D8 copy sheet. Thus, the striped areas Mc overlie some of the toned areas Mp on the copy sheet types D9. After all the document types D9 are made, they may be bound in the on-line finisher or bound off-line. The book or pamphlet made thus includes pages of striped areas of high coercivity magnetic toner Mc overlying portions of the area toned with the permeable magnetic toner Mp.

Other methods of reproducing documents of type D9 may comprise using a copying operation wherein a master sheet is provided on the exposure platen with a series of stripe-like patterns along one edge thereof and copying this pattern onto each image frame. The image frames are developed with the higher coercivity toner and transferred onto copy sheets of type D8 stored in the paper supply tray. Still another method is to use a copier with three toner stations to form the copy sheets D9 from a supply tray of plain paper. Each of the appropriate images for forming each part of the document are imaged upon the photoconductor and transferred in register to the copy sheets. If desired, a two-developer station copier may be used wherein the highly permeable toner is also used to form the image information and the second station provides the higher coercivity toner.

Figure 15:
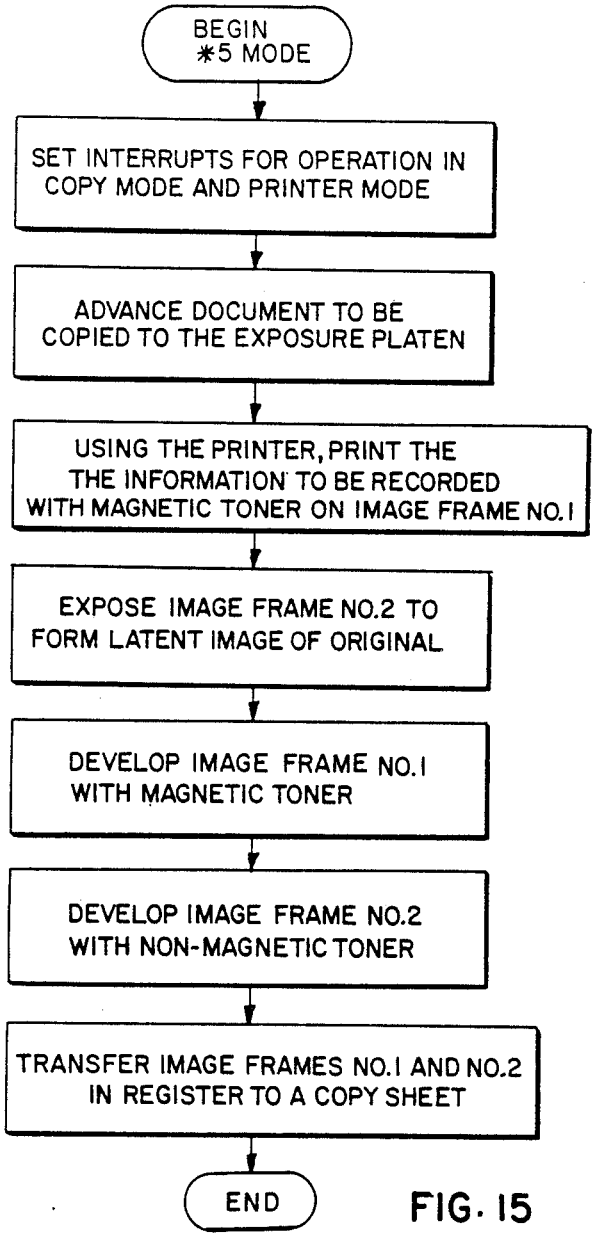

With reference now to FIG. 1 and FIG. 15, the document D1 shown may be reproduced using the technique described for reproducing document D2 except that in lieu of forming a patch area the LED printhead is used to "write", or expose the image frame to be developed with the magnetic toner, with character information. In response to input of a code say *5, a data or character generator 49 may have character data stored such that the LCU 31 activates the LED's to print the data in the area or areas of the image frame used to reproduce the information to be developed with the magnetic toner. This information may be bank clearing data which can be constant for each different document reproduced or variable depending upon the data desired to be printed. The remainder of the document containing the information to be reproduced with non-magnetic toner is fed to the exposure platen 84 and exposed onto an adjacent image frame by activation of the lamps 90, 92 and this image frame developed with non-magnetic toner. The two developed image frames are transferred in register to a copy sheet to form the composite image.

Figure 16:
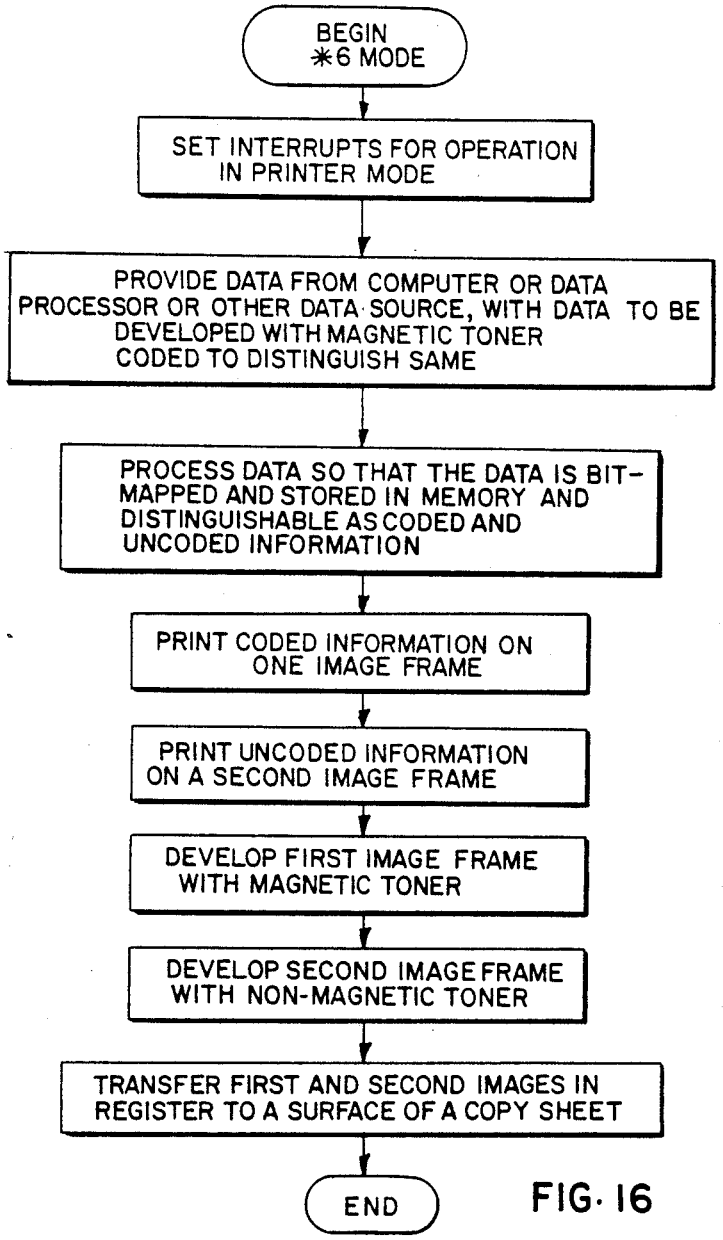

With reference now to FIG. 16 illustrating a mode called up by say a code *6, copier/printer apparatus of the invention is also useful in a printer only mode where it is desired to produce documents of the type illustrated in FIG. 1, without having a corresponding hard copy original to form part of the image. A computer data store may have the originals stored in tape or diskette or memory. The signals from the computer can then be processed by the LCU 31 to print the information using the LED printhead. In this regard, the data will be coded or otherwise differentiated so as to identify which data is to be printed with magnetic toner. Thus, the LCU can construct two bit maps of the images to be printed. One bit map will contain the information to be printed on the image frame to be developed with non-magnetic toner and the other bit map will contain the information to be printed on a second image frame that is developed with magnetic toner. The developed two image frames can then be transferred in register to a single copy sheet to form the composite image of a document such as document type D1.

While the invention has been described with regard to formation of images using light reflecting from or transmitted through a document to expose a photoconductor, it will be appreciated that original documents may be exposed onto photosensitive devices such as CCD's or the like. With such devices electronic signals are created that are used to modulate light from an electronic source such as a laser beam or LED printhead to expose the information upon the photoconductor.

Still other modifications from the preferred embodiment may be made by substituting electric stylii for the LED printhead. In its broader aspects, the invention may be performed by ink jet and other reproduction systems.

Although the invention has been described in detail with particular reference to a preferred application and embodiment thereof, it will be understood that variations and modifications can be effected within the scope and spirit of the invention.

We claim:

1. In an apparatus for the reproduction of an original document having a first image area with visible image content formed with non-metallic pigment and a second image area with visible image content formed with metallic pigment, the apparatus including a recording element;

an exposure station for supporting a document for exposure;

means for exposing a document to light while supported at the exposure station;

reproducing means for recording image information on the recording element and for developing images formed thereon; and the improvement which comprises:

means for sensing the location of an area having metallic image content on said document and generating signals identifying said location; and wherein said reproducing means is responsive to said signals for reproducing on the recording element with non-metallic pigment a visible image corresponding to the first image area and reproducing on the recording element with metallic pigment a visible image corresponding to the visible image of the second image area.

2. The apparatus of claim 1 and further comprising means for transferring from the recording element to a single copy sheet the non-metallic pigment reproducing the image content of the first image area and the metallic pigment reproducing the image content of the second image area to form a reproduction of the original.

3. An apparatus for production of copy, the apparatus comprising:

an electrostatic recording element;

means for producing an electrostatic charge on the recording element that is modulated with image information;

means for developing with a non-magnetic pigment an area of the element that has its electrostatic charge modulated with image information;

means for producing an electrostatic charge on a second area of the recording element for forming an electrostatic image of a patch;

means for developing the second area of the recording element with a magnetic pigment; and means for transferring the pigmented areas to a copy sheet to form a composite of the image area and a patch area that may be selectively magnetized for magnetic recording on same.

4. The apparatus of claim 3 and including means for selectively magnetizing the patch area with a code.

5. The apparatus of claim 3 and wherein the patch is formed along an area of an image frame corresponding to a margin area of a copy to be reproduced.

6. The apparatus of claim 5 and including means for binding along margins thereof copies having magnetic patches at said margins.

7. An apparatus for production of copy, the apparatus comprising:

an electrostatic recording element;

means for producing an electrostatic charge on a first area of a recording element which charge is modulated with image information;

means for developing with a non-magnetic pigment the first area to form a visible image of the image information;

means for producing an electrostatic charge on a second area of the recording element that is modulated with character information;

means for developing the second area of the recording element with a magnetic pigment to form a visible image of the character information;

means for transferring the pigmented areas to a copy sheet to form a composite of the image area and the character information area, the character information area being developed with the magnetic pigment to enable same when magnetized to be machine readable by a magnetic reader.

8. In a method for the secure reproduction of documents, the method including the steps of feeding documents seriatim to an exposure station; supporting a document to be reproduced for exposure; exposing the document to light while supported at the exposure station; the improvement comprising:

sensing the presence of metallic pigment present on said document as visible character image information content while said document is moving toward or away from said exposure station and generating a first signal identifying said document as containing or not containing metallic content and thereby distinguishing the nature of the document as a secure or not secure document;

determining a user's authorization to make copies of secure documents and providing a second signal indicative of said authority; and in response to said first and second signals reproducing the character image information content of said document with a visible metallic pigment when said signals define such authorization and sensing of a secure document.

9. The method of claim 8 and wherein the metallic pigment forming the visible image information is magnetized with an invisible magnetic code pattern of different information content than the visible image information and wherein the code pattern is sensed in the sensing step and generates signals related to this pattern and these signals are compared with a code stored in a memory to determine the nature of the document as a secure or not secure document.

10. A method for the reproduction of an original document having a first image area with visible image content formed with non-metallic pigment and a second image area with visible image content formed with metallic pigment, the method comprising the steps of exposing a document to light while supported at an exposure station;

sensing the location of the area having the metallic content on said document and generating signals identifying said location; and in response to said signals reproducing on the recording element an image area corresponding to the first image area with non-metallic pigment and reproducing a visible image corresponding to the visible image content of the second image area with metallic pigment.

11. The method of claim 10 and including the steps of electrostatically charging the recording element; modulating the electrostatic charge on the recording element with the visible image content of the original; and transferring to a copy sheet the non-metallic and metallic pigments to form a reproduction of the original.

12. A method for the production of copy, the method comprising the steps of:

producing on an electrostatic recording element an electrostatic charge that is modulated with image information;

developing with a non-magnetic pigment an area of the element that has its electrostatic charge modulated with image information;

producing an electrostatic charge on a second area of the recording element for forming an electrostatic image of a patch;

developing the second area of the recording element with a magnetic pigment; and transferring the pigmented areas to a copy sheet to form a composite of the image area and a patch area that may be selectively magnetized for magnetic recording on same.

13. The method of claim 12 and including the step of selectivity magnetizing the patch area with a code.

14. The method of claim 12 and wherein the patch area is formed along an area of the copy sheet corresponding to a margin area thereof.

15. The method of claim 14 and wherein a series of second areas of a higher coercivity magnetic pigment are formed upon the copy sheet containing a magnetic patch area of lower coercivity.

16. A method for production of copy, the method comprising the steps of:

producing an electrostatic charge on a recording element which charge is modulated with image information;

developing with a non-magnetic pigment the area of the element that has its electrostatic charge modulated with image information;

producing an electrostatic charge on a second area of the recording element that is modulated with character information;

developing the second area of the recording element with a magnetic pigment to form a visible image of the character information;

transferring the pigmented areas to a copy sheet to form a composite of the image area and the character information area, the character information area being developed with the magnetic pigment to enable same when magnetized to be machine readable by a magnetic reader.

17. In an apparatus for the reproduction of copy having a first image area with visible image content formed with non-metallic pigment and a second image area with visible image content formed with metallic pigment, the apparatus including;

a recording element;

an exposure station for supporting a document for exposure;

means for feeding documents seriatim to the exposure station;

means for exposing a document to light while supported at the exposure station;

means for recording image information on the recording element and for developing images formed thereon; and the improvement which comprises:

means for sensing the location of an area having metallic image content on said document while said document is moving toward or away from said exposure platen and generating signals identifying said location; and control means for controlling the feeding means and the exposing means for recording on said recording element the visible information content contained on a first document and the visible information content contained on a second document, wherein one of said first and second documents contains visible image information formed with metallic pigment and the other of said first and second documents contains visible image information formed with non-metallic pigment and reproducing means for recording and developing on the recording element with a visible metallic pigment a reproduction of the information content of said first document and for recording and developing on the recording element with a visible non-metallic pigment a reproduction of the information content of said second document and means for transferring from the recording element to a single copy sheet the metallic pigment reproducing the image content of said first document and the non-metallic pigment reproducing the image content of the second document.

18. In a method for the reproduction of copy having a first image area with visible image content formed with non-metallic pigment and a second image area with visible image content formed with metallic pigment, the method including the steps of:

feeding documents seriatim to an exposure station;

exposing the document to light while supported at the exposure station;

recording image information on the recording element and developing images formed thereon; and the improvement which comprises:

sensing the location of an area having metallic image content on said document and generating signals identifying said location and controlling the feeding means and the exposing means for recording on said recording element the visible information content contained on a first document and the visible information content contained on a second document, wherein one of said first and second documents contains visible image information formed with metallic pigment and the other of said first and second documents contains visible image information formed with non-metallic pigment and recording and developing on the recording element with visible metallic pigment a reproduction of the information content of said one document and for developing on the recording element with visible non-metallic pigment a reproduction of the information content of said other document and transferring from the recording element to a single copy sheet the metallic pigment reproducing the image content of said one document and the non-metallic pigment reproducing the image content of said other document.

19. A method for the secure reproduction of documents, comorising:

sensing the presence of metallic material present on said document and generating a signal identifying said document as containing metallic content;

forming an electrostatic image of said document on a recording element;

developing said electrostatic image with a non-metallic pigment and developing a portion of said recording element with a metallic pigment; and transferring the non-metallic and metallic pigments to a copy sheet to form a secure copy.

* * * * *